US005199727A

United States Patent [19]

Lai

[11] Patent Number: 5,199,727

[45] Date of Patent: Apr. 6, 1993

[54] STEERABLE WHEEL ASSEMBLY FOR A ROLLER SKATE

[76] Inventor: Kuo J. Lai, No. 30, Alley 9, Lane 25, Chin-Li St., Tou-Cheng Shiang, Taipei Shian, Taiwan

[21] Appl. No.: 845,154

[22] Filed: Mar. 3, 1992

[51] Int. Cl.[5] ..... A63C 1/24

[52] U.S. Cl. ..... 280/11.28; 280/11.19; 280/11.23; 301/5.3; 301/105.1

[58] Field of Search ..... 280/11.28, 11.19, 11.22, 280/11.23, 11.25, 11.27, 87.042; 301/5.3, 5 R, 109, 105 R

[56] References Cited

U.S. PATENT DOCUMENTS

| | | | |
|---|---|---|---|
| 311,936 | 2/1885 | Wisewell | 280/11.28 |
| 329,927 | 11/1885 | Mendenhall | 280/11.28 |
| 3,331,612 | 7/1967 | Tietge | 280/11.28 |
| 4,123,076 | 10/1978 | Passoni | 280/11.27 |
| 4,603,868 | 8/1986 | Schütz | 280/11.27 |

*Primary Examiner*—Eric D. Culbreth
*Attorney, Agent, or Firm*—Bacon & Thomas

[57] ABSTRACT

A steerable wheel assembly for use on a roller skate is disclosed. The wheel assembly consists of a wheel having a roller bearing inserted into each side thereof and a shaft installed between the roller bearings. The shaft has journals machined on each end thereof which are fitted into inner rings of the aforementioned roller bearings to enable the wheel to rotate. Machined through the center of the shaft is a channel having a flat upper surface, a lower surface and two slanted surfaces, into which an axle is inserted. The axle includes four flat surfaces and, more specifically, two slanted surfaces which are parallel to and offset a predetermined clearance distance from the two slanted surfaces of the channel, a top surface and a bottom surface. The top and bottom surfaces of axle the are parallel to and positioned at a predetermined distance from the upper and lower surfaces of the channel respectively. The axle pivots on centered ball bearings and is supported on the bottom by elastic cushions. When a skater learns to alter the center of gravity or exerts more leg pressure on one of the roller skates equipped with the invention herein, the aforementioned axle sways to the biased side by pivoting on the aforementioned ball bearings, thereby causing the wheel to cant towards the same side and results in the body turning in the desired direction.

3 Claims, 6 Drawing Sheets

STEERABLE WHEEL ASSEMBLY FOR A ROLLER SKATE

BACKGROUND OF THE INVENTION

1. Field of the Invention

The invention pertains to a steerable wheel assembly and, more specifically, an improved wheel assembly that, when installed on roller skates or the like, provides excellent control capability while using one leg, two legs or executing relatively small radius sharp turns.

2. Description of the Prior Art

As indicated in FIG. 1, a conventional roller skate (10) consists of a number of assembled parts, including a boot (11), a base plate (12), a shock reducer (13), four wheels (14), axles (15) and a movement controller (16).

Such conventional roller skates have a fixed axle design so there is no way to directly execute a turn and the height of the legs above the ground must be adjusted to change the skating direction. More specifically, during the execution of a turn, the outer leg must be lifted and placed in front of the inner leg and only after the completion of this action can the body be turned in the desired direction. As a result, the utilization of a conventional roller skate produces the following disadvantages during the execution of turns:

First, since the conventional roller skate is turned indirectly, control is inadequate and it is difficult for beginning skaters to master the required technique.

Second, since only one foot is on the ground during a turn when using conventional skates, overall skating stability is reduced and it is firstly easy to slip and fall because of the imbalanced center of gravity.

Third, conventional roller skates exhibit a relatively large turning radius during turn execution and therefore require larger rink areas to afford sufficient skating.

Fourth, it is impossible to turn on one foot only with conventional roller skates since both feet must be alternated in position to complete the turn and, therefore, no other skating maneuvers can be performed while executing a turn.

SUMMARY OF THE INVENTION

The main object of the invention herein is to provide an improved roller skate wheel assembly that directly influences the turning efficiency of roller skates, while also enabling a higher degree of skater control.

Another object of the invention herein is to provide a kind of improved roller skate wheel assembly that enables the execution of a turn while both legs are in contact with the ground in order to accord increased stability during turning maneuvers.

A further object of the invention is to provide an improved roller skate wheel assembly that enables the execution of a varied and continuous series of turning maneuvers with one leg or two legs such that when one leg is utilized to execute a turn, the other leg is free to undertake other performing movements.

These and other objects of the invention are accomplished by providing a wheel having roller bearings installed at both sides thereof and a shaft enclosed in a compartment between the roller bearings. At the ends of the shaft are journals which are inserted into inner rings of the roller bearings so as to enable the wheel to rotate. Furthermore, a channel is machined through the shaft. The channel has an upper surface, a lower surface and two slated surfaces through which an axle is inserted. The axle has two slanted surfaces that are parallel to the slanted surfaces of the channel and are sized to maintain a predetermined clearance between the slanted surfaces of the channel and the axle. The axle also has a top surface and a bottom surface which are set a given distance away from the upper and lower surfaces of the channel respectively. In addition, the axle is suspended at the center on ball bearing pivot points and is simultaneously supported on the bottom surface by components made out of an elastic material. When a skater leans his body to alter the center of gravity or exerts more leg force downward over one roller skate, the axle will say to one side, pivoting on the ball bearings, causing the wheel to cant in the direction of the altered center of gravity or leg bias to thereby enable the body of the skater to turn.

To thoroughly understand the remaining objectives and advantages of the invention, the appended drawings and accompanying description of a preferred embodiment of the invention are provided below for further reference.

DETAILED DESCRIPTION OF THE PREFERRED EMBODIMENT

Figure 1:
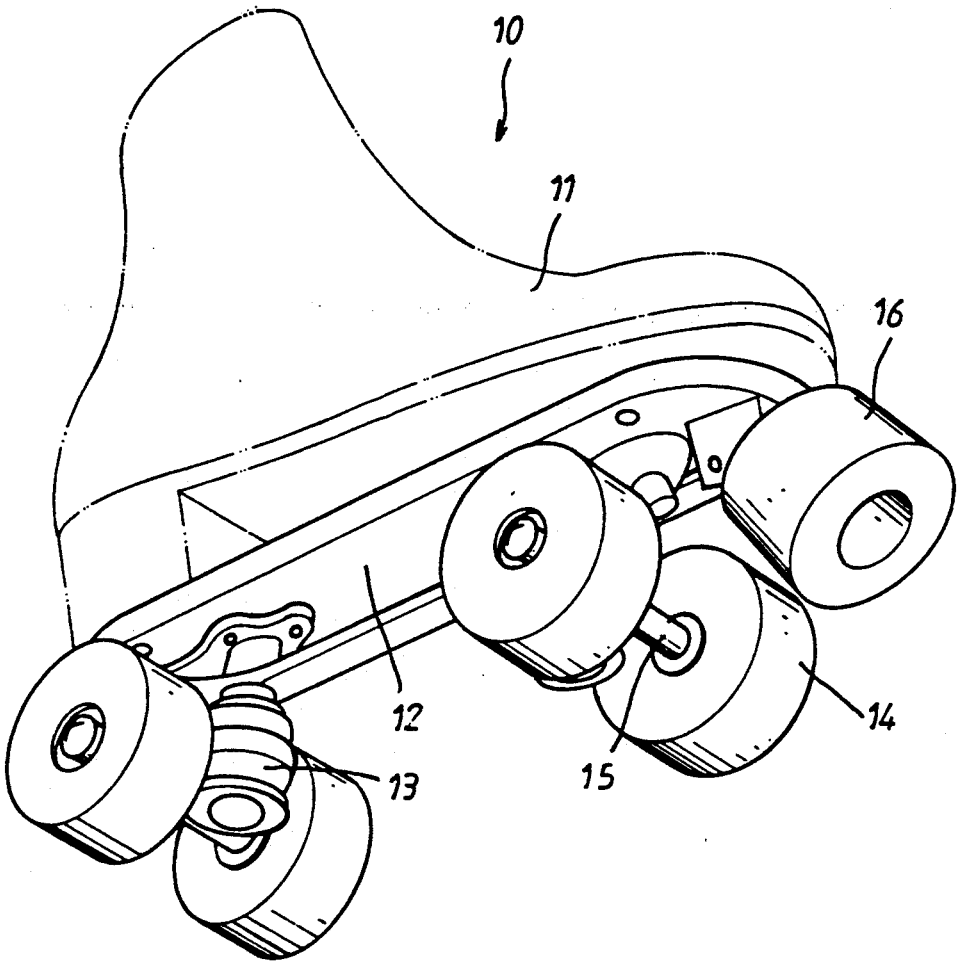
FIG. 1 (PRIOR ART)
FIG. 1 depicts a conventional roller skate.
Figure 2:
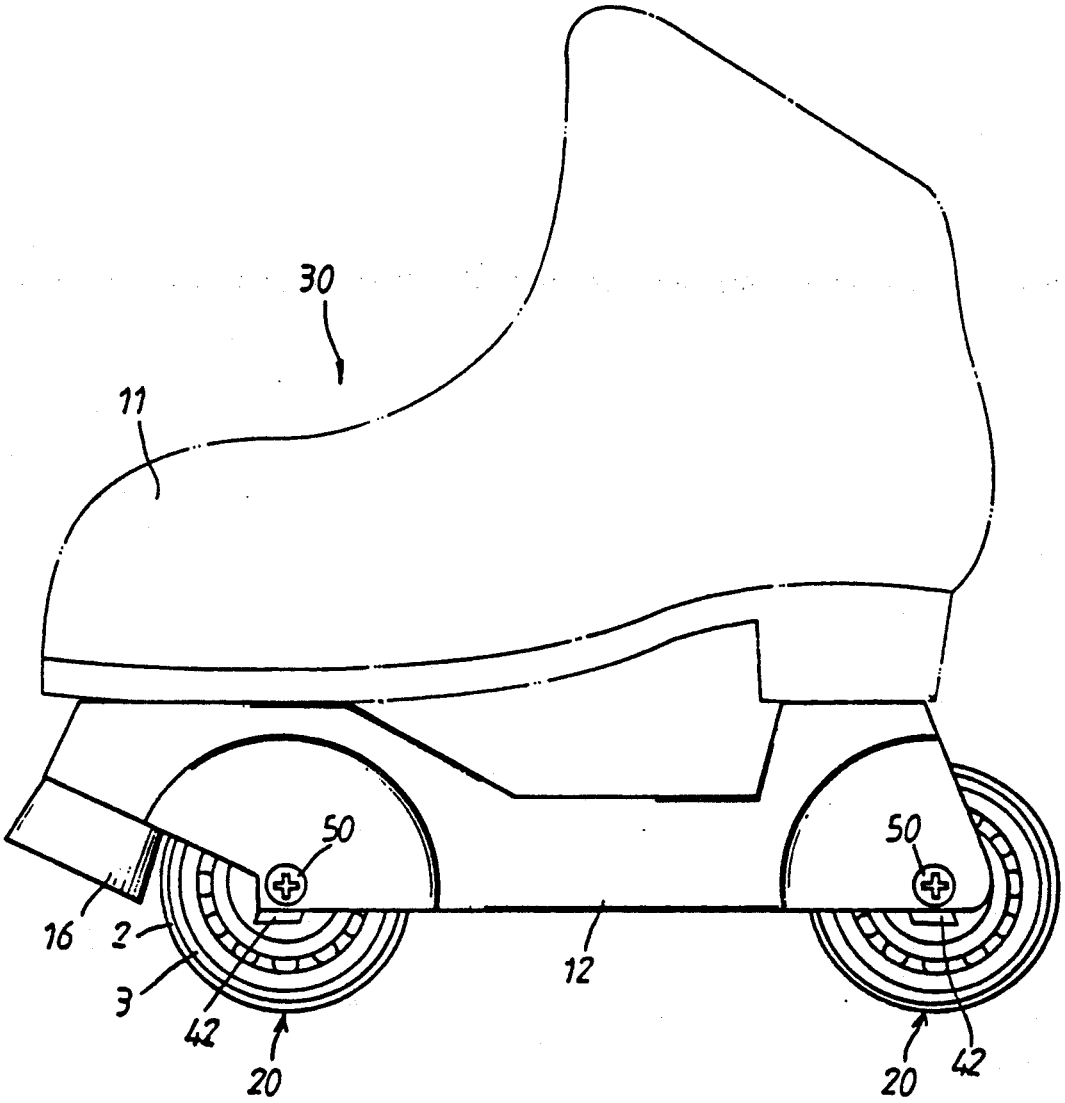
FIG. 2 is a side view of a roller skate equipped with wheel assemblies according to the present invention.

The steerable wheel assembly of the present invention will now be explained in detail with reference to FIGS. 2–8. FIG. 2 shows front and rear roller skate wheels 20A and 20B according to the invention installed on a roller skate boot 30. As indicated in FIG. 2, each roller skate boot 30 requires a forward roller skate wheel 20A and rear roller skate wheel 20B, resulting in a roller skate boot with fore and aft roller skate wheels, which is different than the conventional roller skate boot shown in FIG. 1 that has four roller skate wheels. Of course, the roller skate wheels 20A and 20B of the present invention can also be installed on a roller skate boot originally equipped with four roller skate wheels and, furthermore, a roller skate boot equipped with the roller skate wheels 20A and 20 of the present invention can be used to skate on both ice and other smooth surfaces.

Figure 3:
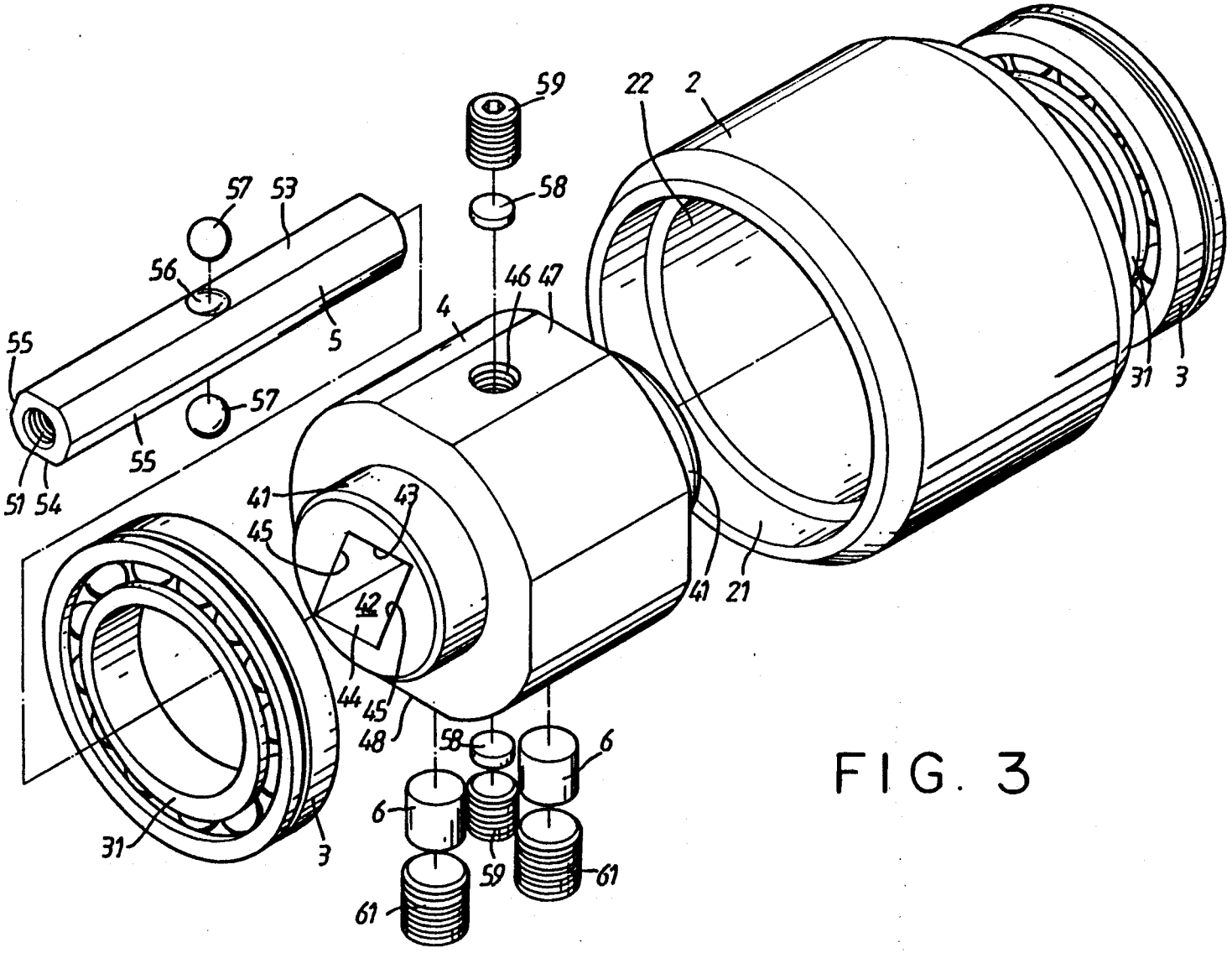
FIG. 3 is an exploded view of one of the roller skate wheels of the invention.
Figure 5:
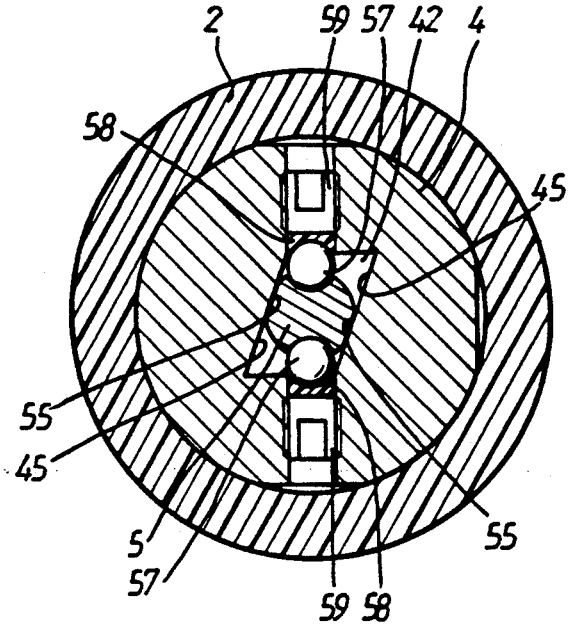
FIG. 5 if a cross-sectional side view which depicts the steering mechanism of the roller skate wheel assembly of the invention.
Figure 4:
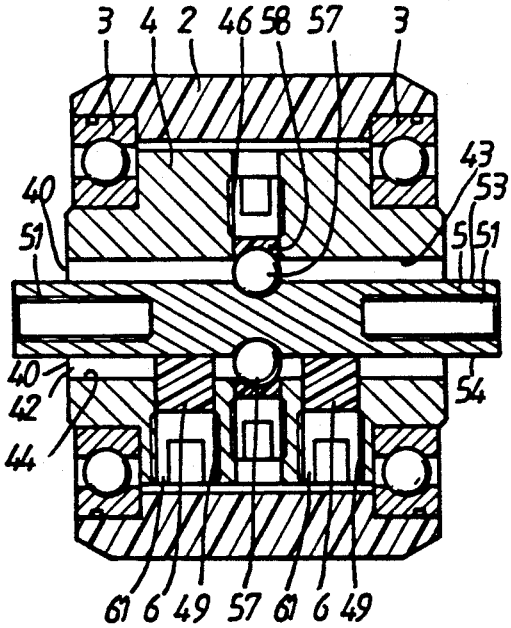
FIG. 4 is a cross-sectional view of the roller skate wheel shown in FIG. 3 in an assembled state.

As indicated in FIG. 3, the roller skate wheel assemblies of the present invention each include a hollow wheel 2, a section which is preferably made out of pliable resinous material and formed with two bearing housings 21 molded inside. Bearing housings 21 located respective roller bearings 3 within wheel 2 in order to permit rotation of wheel 2. A compartment 22 is molded between the two aforementioned bearing housings 21 to accommodate the insertion of a shaft 4. As indicated in FIGS. 3 and 4, shaft 4 is adapted to be inserted into the compartment 22 in the wheel 2. Both ends of shaft 4 are reduced in relative outer diameter to form journals 41 which fit into the inner rings 31 of the aforementioned roller bearings 3. By this construction, shaft 4, roller bearing 3 and wheel 2 may be assembled into a single composite unit.

Figure 7:
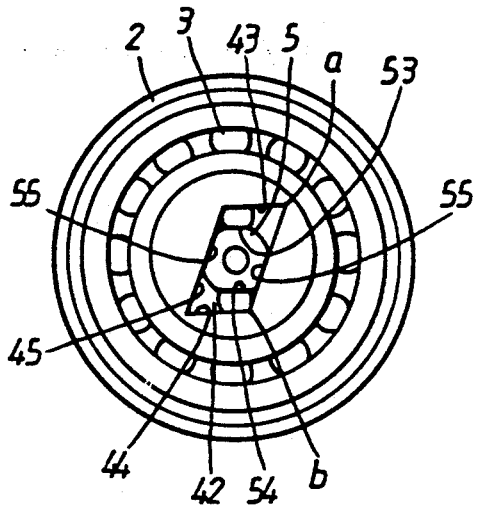
FIG. 7 is a cross-sectional view of the roller skate wheel assembly of the invention showing details of the axle.

Machined through the center of shaft 4 is a passage 42. Passage 42 has an upper surface 43 and a lower surface 44 and two slanted surfaces 45. Passage 42 serves as a quadrilateral passage for the insertion of an axle 5, while also guiding the movement of axle 5 and the directional orientation of wheel 2 as will be explained more fully below. As indicated in FIG. 7, passage 42 determines the direction of wheel 2 based on the upper limit (a) and lower limit (b) along an identical perpendicular line imposed by inner slanted surfaces 45.

Referring once again to FIGS. 3 and 4, the axle 5 is adapted to be inserted through passage 42 so that the end sections of the axle 5 protrude from the two ends of shaft 4. Moreover, there is countersunk threaded hole 51 on each end of axle 5 to accommodate the fastening of a screw 50 to each of the ends which (as indicated in FIG. 2) secure the roller skate wheels 20A and 20B to the roller skate frame 12. There are four flat surfaces machined onto axle 5, i.e, a top surface 53, a bottom surface 54 and two angularly offset surfaces 55 situated at approximately 45 degrees and 225 degrees, respectively, relative to the center line of axle 5. When the axle 5 is installed inside passage 42, the top surface 53 and the bottom surface 54 of axle 5 are positioned parallel to the upper surface 43 and the lower surface 44 of passage 42 respectively, with a predetermined distance 40 maintained between the top surface 53 of the axle 5 and the upper surface 43 of passage 42 as well as between the bottom surface 54 of axle 5 and the lower surface 44 of passage 42. The angularly offset surfaces 55 of axle 5 make light contact with the slanted surfaces 45 of passage 42 such that a tiny clearance (the size of the clearance is not indicated in FIG. 7) is maintained between the angularly offset surfaces 55 of axle 5 and the slanted surfaces 45 and passage 42 to enable movement of axle 5 within passage 42. The aforementioned slanted surfaces 45, the axle 5, the upward and downward movement range allowed by the fixed distance 40 within passage 42 and the roller wheel 20A or 20B all contribute to produce a variable range of turning angles as will be discussed below.

As indicated in FIGS. 3 and 4, in order to support the pivoting movement of axle 5, a bearing recess 56 is machined at the center of both the top surface 53 and the bottom surface 54 of axle 5. Bearing recess 56 holds a ball bearing 57 in place on each of the aforesaid surfaces. More specifically, one portion of each ball bearing 57 is received within the bearing recess 56, while the other portion of each ball bearing 57 is received within the lower ends of threaded holes 46 tapped into the top surface 47 and into the bottom surface of shaft 4. An Allen-head set screw 59 is then installed through each of the aforementioned threaded holes 46 to exert a suitable degree of pressure that will allow ball bearings 57 to revolve freely when implaced as a pivot point so as to enable axle 5 to turn. The threaded holes 46 tapped into the top surface 47 and the bottom surface 48 of shaft 4 penetrate through to the upper surface 43 and the lower surface 44 of passage 42 respectively. A resilient contact bushing 58 is positioned between each ball bearing 57 and a lower tip of the Allen-head set screws 59 which serves to prevent the wearing away of the aforesaid ball bearing 57.

In order to enable axle 5 to return to its original level position, two threaded holes 49 are tapped into the bottom surface 48 of shaft 4. The centers of threaded holes 49 are in line with the center threaded hole 46, also tapped into bottom surface 48 of the shaft 4. Each of the threaded holes 49 accommodate both the implacement of a cylindrical cushion 6 and the installation of an Allen-head set screw 61. Set screws 61 adjustably secure the cylindrical cushions 6 such that the resulting tension causes axle 5 to revert to the original level position shown in FIG. 4, while also providing weight support and absorbing shock. Of course, cylindrical cushion 6 can comprise a compressible spring or other component with similar elastic properties.

Since the details contained in the appended drawings and the accompanying explanations refer only to a preferred embodiment of the invention, they should not be construed as constituting any intended limitation whatsoever and the substitution of any individual component or components which duplicate the basic innovations thus far described should be considered as within the principles and scope of the invention.

Figure 6:
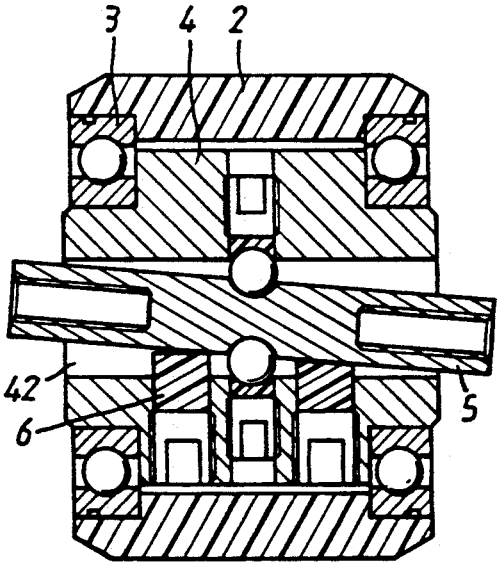
FIG. 6 is a cross-sectional view of the roller skate wheel assembly of the invention, similar to that shown in FIG. 4, but depicting the axle at a skewed angle.
Figure 8:
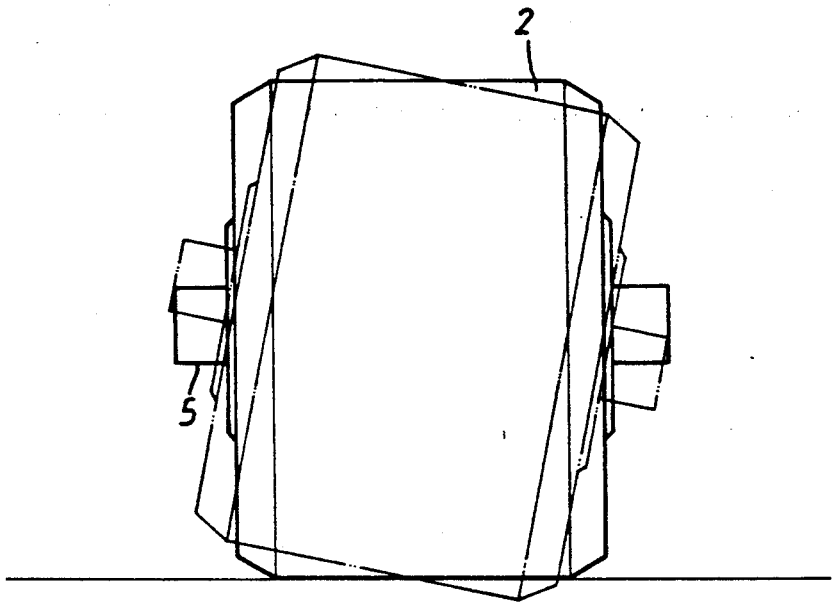
FIG. 8 is the rear view of the invention showing the position of roller skate wheel during a right turn, illustrating that when a right turn is executed, the right side of the roller skate wheel is inclined to the right, while the left side of the roller skate is canted upward to the left.

The following section shall explain how the aforementioned roller wheels 20A and 20B of the invention herein are controlled on the roller skate boot to execute a right turn. As indicated in FIG. 6, during execution of a right turn, the skater transfers his body's center of gravity to the right by exerting additional leg pressure over the right side of the skate. This action causes the right end of axle 5 with ball bearing 57 serving as a pivot point to travel downward along the slanted surfaces 45 inside passage 42, while the left end of axle 5 travels upward along the upper slanted surfaces 45 inside passage 42. The two ball bearings 57 positioned on shaft 4 serve as the pivot points enabling the movement of the axle 5, as illustrated by the canted state of the axle 5 in FIG. 6. As a result, the right side of wheel 2 leans downward to the right (note that left and right movement is produced from the same axle), while the left side of wheel 2 is canted upward to the left (as best shown in FIG. 8). Under these conditions, roller skate wheel 20A or 20B is caused to turn towards the right and enables the body of the skater to switch direction to the right. Since the principles underlying the execution of a left turn are identical to those for executing a firth turn, an additional explanation is not necessary. However, it should be noted that if the movement of the rear roller wheel 20B is attributed to the same directional action produced by the axle 5 relative to the direction of the slanted surfaces 45 inside the passage 42 as that for the front roller wheel 20A, then the rolling direction of the rear wheel 20B and the front roller wheel 20A are identical. But, if the movement of the rear roller wheel 20B attributed to the action of the axle 5 relative to the direction of the slanted surfaces 45 inside the passage 42 is opposite to that of the front roller wheel 20A, then the turning capability of the roller skate will be significantly increased in magnitude and the required turning radius will be relatively smaller. In addition, the lateral stress on the roller skate will depend on the combined forces produced by the turning angle of the roller skate as well as the lean angle of the body. Thus, when the lean angle and the lateral stress are small, the angle of the turn will be small and when the lean angle and the lateral stress is great, then the angle of the turn will be large. When the body of the skater returns to a balanced state and the leg force is equally distributed on the roller skates, then axle 5 reverts to a level state parallel to the ground surface as indicated in FIG. 4. Since axle 5 is suspended in a balanced manner inside passage 42, the roller wheels 2 track ahead in a straight line. Similarly, when roller wheels 2 leave the ground surface and the downward force on the roller skate is removed, the elastic action of the cylindrical cushions 6 serves to return axle 5 back to a level state.

As described above, due to the capability of harness shafts in the center of gravity to execute directional changes by changing the lean angle of the body and altering the downward force exerted by the legs, the improved roller skate wheel assembly of the present invention herein provides excellent responsiveness and extreme ease in turning control. Furthermore, since turns can be executed with both roller skates on the ground, the invention herein offers exceptional stability. Moreover, turns can also be executed with both roller skates or just one roller skate on the ground, a capability that enables a skater to perform a wider variety of skillful maneuvers. Also, since the invention herein has a relatively small turning radius, it can be utilized in relatively small areas and still retain exceptional turning performance. Although describe for use in a two wheel roller skate environment, it should be understood that the roller skate wheel assembly of the present invention may be used in various embodiments such as four-wheel roller skates, linear roller skates, skate boards and push carts, without losing the unique advantages of the invention herein. In general, the invention is only intended to be limited by the scope of the following claims.

What is claimed is:

1. A steerable wheel assembly for use on a roller skate comprising:

a) a hollow wheel, having first and second ends, including a bearing housing molded therein at both of said ends, with a reduced diameter compartment molded in between said bearing housings;

b) first and second roller bearings each of which is mounted in a respective one of said bearing housings;

c) a shaft received in said reduced diameter compartment of said hollow wheel, said shaft including a journal formed on each end thereof, each of said journals being inserted into a respective one of said roller bearings such that said hollow wheel may rotate relative to said shaft upon said first and second roller bearings, said shaft further including a passage, formed through the center line of the shaft, having an upper surface, a lower surface and two slanted surfaces, a first threaded hole tapped through a central portion of said shaft, substantially perpendicular to said passage which entirely penetrates the upper and lower surfaces of said passage and said shaft, and second and third threaded holes which extend through said shaft into said passage;

d) an axle received within said passage with each end of said axle protruding from said passage and including a threaded hole formed therein, said axle having four flat surfaces including top and bottom surfaces that are parallel to and positioned a predetermined distance from the upper and lower surfaces of said passage respectively, said axle further including centrally located, hemispherical recesses formed in the top and bottom surface of said axle, the remaining two flat surfaces of said axle being flush with the two slanted surfaces of said passage with a predetermined clearance therebetween;

e) first and second ball bearings, each of bearings being positioned between one of said hemispherical recesses of said axle and said first threaded hole formed in said shaft with a set screw being installed into each end of said first threaded hole over a respective ball bearing in order to govern the pivoting movement of the axle;

f) first and second cylindrical cushions, each of said cylindrical cushions being located in a respective one of said second and third threaded holes in said shaft between said axle and a respective set screw in order that the set screw may adjust the elasticity applied to the axle, wherein said axle may pivot on said first and second ball bearings upon an application of force to said axle during use of said steerable wheel assembly whereby the action of said axle causes said hollow wheel to cant so as to permit said wheel assembly to turn.

2. The steerable wheel assembly of claim 1, wherein said cushions are constructed out of an elastic material in the shape of a cylinder.

3. The steerable wheel assembly of claim 1, further comprising resilient contact bushings located between said ball bearings and their associated set screws.

* * * * *